United States Patent [19]

Asplund

[11] 4,166,584

[45] Sep. 4, 1979

[54] APPARATUS FOR PRODUCING PULP FROM LIGNOCELLULOSE-CONTAINING MATERIAL

[76] Inventor: Arne J. A. Asplund, Tykövägen 20 181 61 Lidingö 3, Sweden

[21] Appl. No.: 863,662

[22] Filed: Dec. 23, 1977

Related U.S. Application Data

[63] Continuation of Ser. No. 717,644, Aug. 25, 1976, abandoned.

[30] Foreign Application Priority Data

Sep. 5, 1975 [SE] Sweden ..... 7509904

[51] Int. Cl.[2] ..... B02C 7/12

[52] U.S. Cl. ..... 241/261.3; 241/298

[58] Field of Search ..... 211/244, 247, 260, 261, 211/261.2, 261.3, 296–298

[56] References Cited

U.S. PATENT DOCUMENTS

| | | | |
|---|---|---|---|
| 1,098,325 | 5/1914 | Kihlgren | 241/261.3 X |
| 1,226,032 | 5/1917 | Nostrand | 241/261 X |
| 3,845,909 | 11/1974 | Joaansson | 241/247 X |

FOREIGN PATENT DOCUMENTS

| | | | |
|---|---|---|---|
| 1217754 | 5/1966 | Fed. Rep. of Germany | 241/261.3 |
| 848569 | 9/1960 | United Kingdom | 241/261 |

*Primary Examiner*—Howard N. Goldberg
*Attorney, Agent, or Firm*—Eric Y. Munson

[57] ABSTRACT

Apparatus for producing pulp from lignocellulose-containing material in which the material is ground into grist in a grinding space defined between a rotating disc and a stationary disc mounted within a pressurized housing. Each disc comprises a series of annularly disposed arched segments having a plurality of radially extending bars and interconnecting transverse ribs defining a plurality of radially arranged pockets which in their radial cross sections have a curved contour. The pockets on one of the discs are offset radially from the pockets on the other disc, to allow the grist in the rotating pockets to be axially deflected by the centrifugal force created by the rotation and collected in an opposing offset pocket on the other disc. During the rotation of the disc, successive charges of grist deflected by the rotating pockets will force the grist previously collected in the stationary pockets to slide along the curved contour and be tilted or dumped into the corresponding offset rotating pocket. The portion dumped into the rotating pocket is sheared off by the following bar as it passes the opposing bar on the stationary disc and subsequently deflected by centrifugal force into a successive offset pocket on the stationary disc and is dumped from there into a successive pocket on the rotating disc and sheared off. The grist thus progresses stepwise towards the periphery of the discs, where it is discharged upon completion of the grinding operation into the grinding housing, from which it is subsequently removed for further treatment.

4 Claims, 8 Drawing Figures

APPARATUS FOR PRODUCING PULP FROM LIGNOCELLULOSE-CONTAINING MATERIAL

This is a continuation, of application Ser. No. 717,644 filed Aug. 25, 1976, now abandoned.

BACKGROUND OF THE INVENTION

My invention relates to the production of pulp from fibrous ligno-cellulose materials, such as wood chips and other fibrous vegetable materials and more particularly to pulping processes which are generally termed "mechanical processes" in which the ligno-cellulose material is fiberized between the grinding discs of a refiner.

The refiner discs may either be of the counter-rotating kind or one of the discs may rotate while the other one is stationary.

In the latter instance the raw material is fed through the center of the stationary disc into the space between the discs and by the action of elements affixed to the rotary grinding disc the material is accelerated and by centrifugal forces finally conducted in between the grinding elements of the grinding zone.

The pulp produced is mainly intended for use in the manufacture of newsprint, cardboard, tissue paper and similar products.

As raw material, fibrous ligno-cellulose materials from wood or other plants, e.g. bagasse may be used. The method used can be classified as a mechanical process and can be carried out under normal atmospheric conditions or in a steam atmosphere at temperatures above 100° C., generally at a temperature between 110° C. up to 140° C. or under special conditions in the temperature range between 150°-170° C. When the mechanical process is carried out at a temperature above 100° C. it is generally classified as "thermomechanical".

SUMMARY OF THE INVENTION

One of the purposes of the invention is to improve the production of pulp in such a way that the fibers of the raw material are separated from each other without being unduly shortened and so that the fibers are further refined to improve their papermaking properties, this process being accomplished by frictional forces generated within the moist fibrous ligno-cellulose material. In the following, the material being processed between the grinding discs will be called "grist". As the individual fibers in the "grist" have a considerable springiness, the grist will develop a considerable volume of capillary voids increasing its capability to hold moisture.

A further purpose of the invention is to reduce the energy required for the pulping process.

During the process of refining, the grist is a moist agglomeration of the processed raw material, which, if it is of coniferous origin e.g. spruce, consists mainly of 2 to 3 mm long tracheids with a slenderness ratio of around 100 to 1. The tracheids in their turn are anatomically built up from three concentric layers of lamallae with a thickness of about one thousandth of one millimeter and a layer of fibrillae helically arranged around a fourth lamella surrounding the innermost tubular space, the lumen. The fibril has a slenderness ratio of about 1000 to 1 but taken together it is estimated that they constitute about 70–80% of the substance of one tracheid. One of the objects of my invention is to separate with a high degree of efficiency the fibers from each other and furthermore by a surface abrasion process to affect the lamellae to such a degree that the fibrils are partially liberated. This improves the papermaking properties of the pulp produced.

In the apparatus according to the invention the grist is introduced between grinding discs of a refiner. Each disc is equipped with a series of pockets separated by radially arranged bars forming pockets displaced lengthwise relatively to each other in the opposing grinding rings. The pockets have a curved form in cross section which at least in the stationary grinding disc gives the pocket the form of a circular segment of a circle. The grist enters the rotating pockets through the gates and is acted upon by centrifugal forces. At the centrally innermost rotating pocket the grist is deflected by the rotating surface axially towards the stationary disc in order to cause the grist to pass through friction surfaces which are formed by the interaction between the bars of the rotating and the stationary discs whereafter the grist is forced into opposing pockets in the stationary grinding discs, where it becomes compacted with the fibers oriented principally parallel in a radial direction at a right angle to the bar. The grist collected in the stationary pockets will form a relatively compacted body a portion of which is caused by successive deposits of grist from the rotating disc to gradually tilt over into the rotating pocket of the rotating disc. The latter portion of the grist collected in the stationary pocket will then be successively sheared off by the bars of the rotating disc. The friction surfaces generated in the compacted grist by the rapidly moving bar create forces of very high intensity which will act on the individual fibers to mechanically refine the grist. The grist will in this way in steps be conveyed outward stepwise in a radial direction between the rotary and stationary pockets. Each time a portion of the accelerated grist is transferred from a rotating pocket into an opposing stationary pocket the velocity of the grist is reduced to zero. The kinetic energy of the moving grist is transformed into a mechanical force which will compact the grist in the stationary pocket efficiently. When the grist comes to a full stop, this kinetic energy will have raised the temperature of the grist 3°-5° C. depending upon the angular speed of the refiner disc. This compacting force will greatly enhance the formation of frictional surfaces between the bars and the grist and within the grist.

The curved bottom of the pockets is shaped so as to efficiently change the direction of the flow of the grist axially. The grist in these pockets may move with a tangential velocity of 50–120 m/sec depending upon the size of the refiner. The frictional surfaces generated within the grist will delaminate the fibrillate the fibers of the raw material.

BRIEF DESCRIPTION OF THE DRAWINGS

My invention will be understood by reference to the accompanying drawings, which form a part of this specification and show various forms of apparatus by means of which the process may be carried out.

DESCRIPTION OF DIFFERENT EMBODIMENTS OF THE INVENTION

Figure 1:
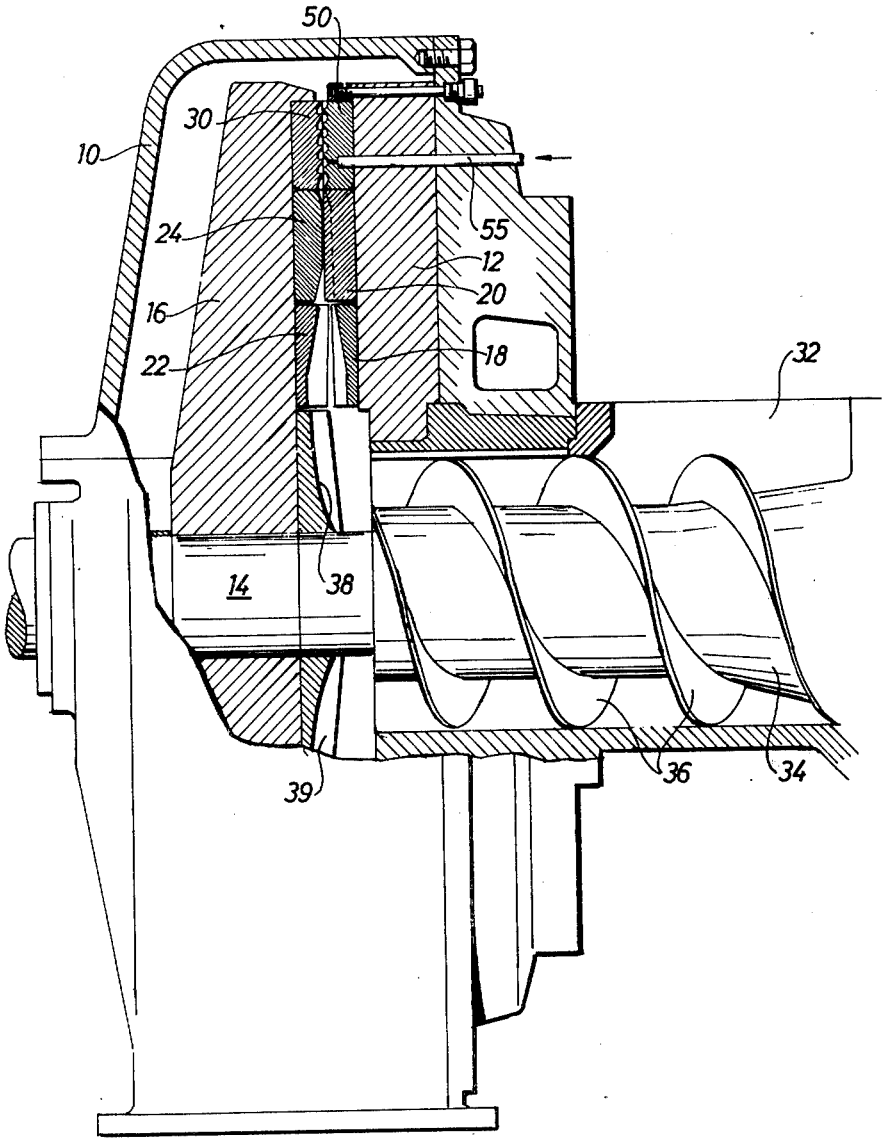
FIG. 1 is a vertical view partly in section of a refiner according to the invention.
Figure 2:
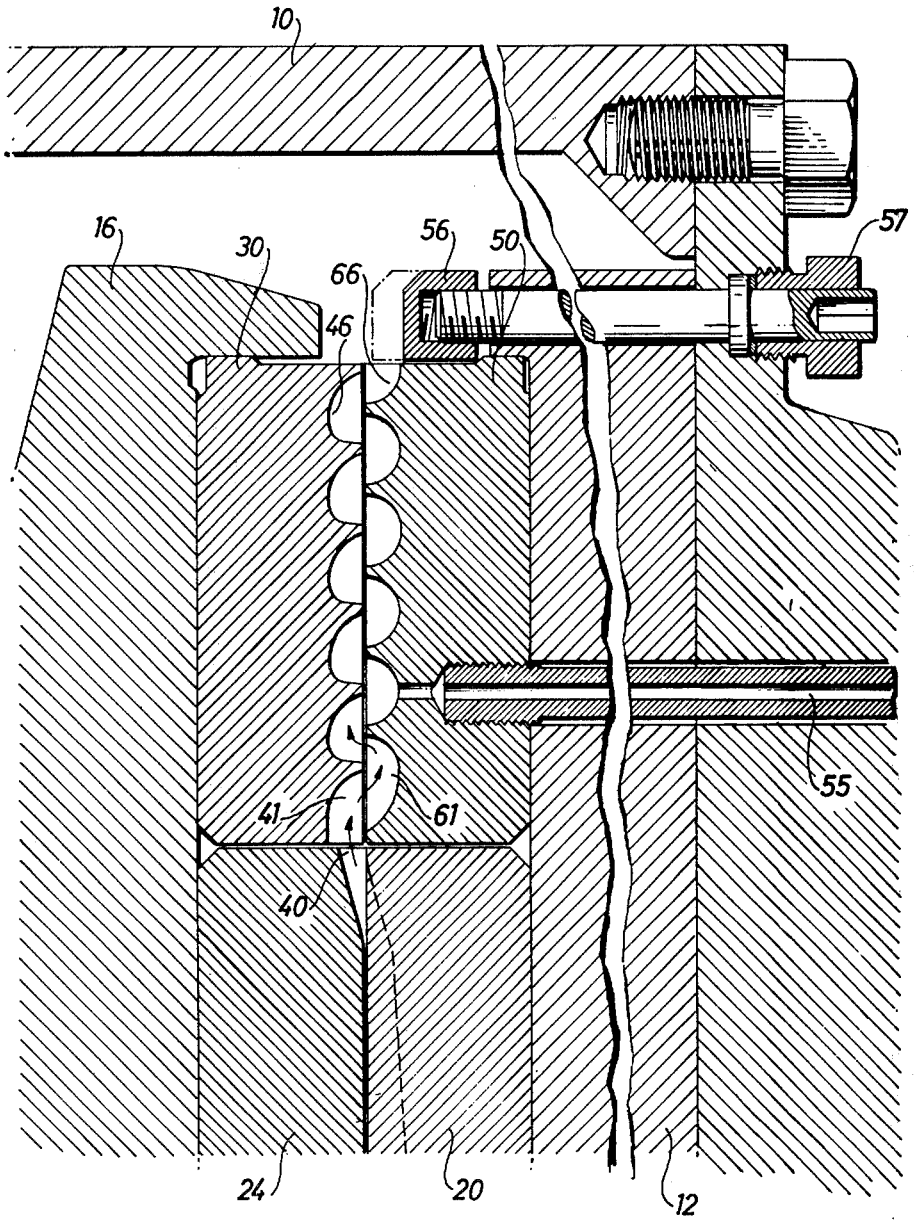
FIG. 2 is a sectional view of a part of FIG. 1 in a larger scale.

On the drawings the numeral 10 designates the housing of the refiner carrying the stationary grinding disc 12. This grinding disc works together with the grinding disc 16 fixed to rotating shaft 14 driven by motor (not shown). The shaft 14 is on each side of the grinding disc 16 supported by bearings which also are not shown on the drawings. In the stationary grinding disc 12 there are three grinding zones 18, 20 and 50 concentrically arranged. Likewise, the grinding disc 16 has three concentrically arranged zones 22, 24 and 30. Three grinding zones are thereby formed, namely one between the elements 18 and 22 in which a preliminary crushing of the admitted raw material, for instance wood chips, takes place. In a second zone formed by the grinding elements 20 and 24 a further coarse defibering takes place before the grist passes into the third grinding zone 30 and 50 of the grinding elements according to the invention. The two innermost grinding zones can be equipped with elements and ribs according to formerly known designs.

The raw material, e.g. chips from wood or other fibrous ligno-cellulose material, is fed through an opening 32 in the housing 10 and is conveyed therefrom by a helical screw 34 equipped with flights 36 through the openings in the central parts of the stationary and rotating grinding discs. A central ring 38 with flights 39 is fastened on the rotating disc 16 to convey the chips further towards the first grinding zone.

According to the invention, in the third grinding zone the two grinding elements 30 and 50, preferably carried out as circle rings with the grinding surfaces opposing each other, are equipped with bars forming the radially arranged pockets, 41 to 46, in the ring 30 and 61 to 66 in the ring 50.

A minor variation from the radial direction of these pockets can be accepted. The pockets of the rotating disc should be formed so as to assist in diverting the grist moving in the pockets sideways from a radial to an axial direction. The curved bottom of the pockets in the stationary discs should preferably have the form of a circle segment.

Figure 3:
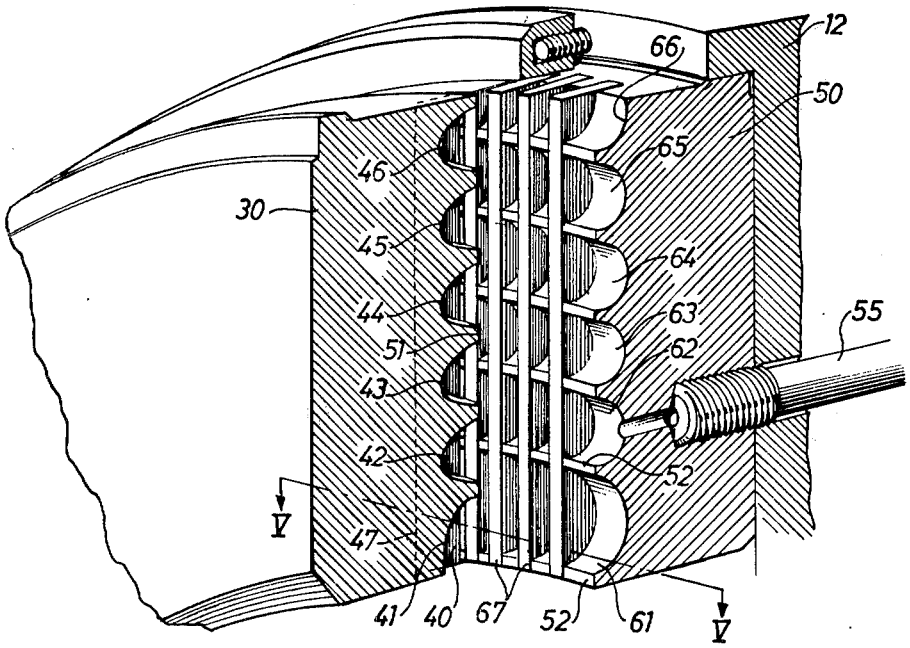
FIG. 3 shows in perspective a part of the grinding disc according to the invention with the portion parallel to the central axle of the refiner shown in section.

The two circular rings 30 and 50 of the grinding discs have been machined to form radial or nearly radial grooves. These grooves should preferably have perpendicular radial extensions which are rectangular in cross-section. In circular ring 30 of the rotating grinding disc the six pockets are designated by numerals 41–46. They are formed by the bars 47 and grooves recessed in the circular rings. In the embodiment shown, the pocket 41 serves as an entrance. The number of the following pockets can if desired be varied within considerable limits. The pockets of the stationary disc are designated by the numerals 61–66 and the separating bars with numeral 67. The pockets are walled in at the sides by the flat bars 67. This can be observed in FIG. 3. The bottom of the stationary pockets 61–66 should have the form of a circle segment. The geometrical center of these segments should be at a point which is somewhat above the edge of the bars defining the radial sides of the pocket. Otherwise the movement of the body of the grist will be hampered. The rotating pockets 42–46 can have the same form but in the section shown this pocket has been extended somewhat to increase its cross section giving it a larger volume than that of the semi circular segments of the stationary disc. This can be seen in FIG. 4. The series of pockets in the two grinding discs are radially offset relative to each other, for instance one half the length of a pocket. The grist is introduced through a gate 40 which forms the entrance of the innermost pocket 41. The outermost pocket 66 of the stationary grinding element is open to allow the ground fibrous pulp or the grist to be discharged into the housing of the refiner.

Figure 4:
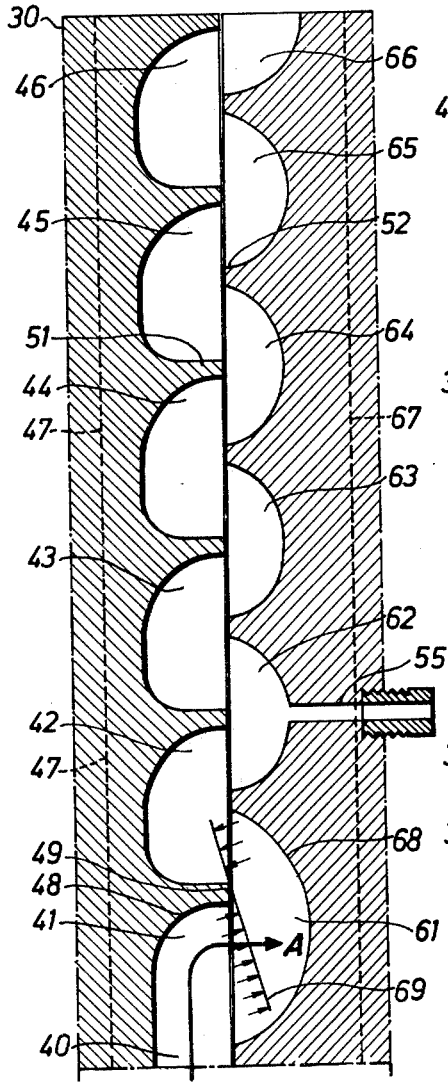
FIG. 4 shows an axial section through the refiner disc.

The bars 47 and 67 radially separating each pocket as shown by the numerals 51 and 52 in FIG. 4 should be made from a material having considerably higher abrasion resistance than the material of the circular rings 30, 50. These pockets extend to the surface of the narrow edges of the bars 47 and 67. The distance between the grinding surfaces of the rings 30 and 50 in axial direction is regulated by the axial adjustment of the refiner shaft. This is often done by a hydraulic servo-motor which in some cases may be adjusted to exert an axial pressure of 30 tons to keep the grinding distance constant. The space may vary between 0.5 mm down to 0.05 mm or even less to obtain the desired refining effect. A distance of 0.8 mm has been used for special pulps. The servo motor should preferably be able to keep this grinding space constant within a margin of 0.01 mm.

As an example of the actual design of a 50" refiner equipped according to the invention may be mentioned that the rotating circular rings 30, 50 may have an outer diameter of 1270 mm and an inner diameter of 1016 mm. The rotating "grinding disc" or the "rotor" 16 is designed to be driven with a speed of 1500 to 1800 rpm. The individual pockets 41 to 46 may have a width of 0.38 cm and a cross-section of 1.5 $cm^2$, which gives a volume of 0.57 $cm^3$. The bars may have a thickness of 3 mm and a width of 15 mm and a length of 127 mm. Such a disc may around the circumference have 504 bars arranged in 72 groups of 7 parallel bars, creating scissor-like cuts instead of the long parallel cuts obtained when the bars are all radially arranged. In the stationary disc 50 the pockets and bars can be arranged in substantially the same way as in the rotating disc 30. The grouping with parallel bars contributes to a more even distribution of the angular torque during operation. Such parallel arrangement of the bars in groups also simplifies the machining of the grinding elements 30 and 50 by allowing a greater number of slots to be milled in one operation.

The refiner operates as follows. In the first zone formed by the elements 18 and 22 the raw material, e.g. the wood chips, is fragmented with moderate energy consumption. In the second grinding zone the material is further broken down between the elements 20 and 24. The grist may then have a "freeness" of 800 ml determined according to the "Canadian Standard Freeness"-method (CSF). The grist then is introduced through the gate 40 and enters pocket 41 in the rotating grinding ring 30. The exit part 48 of the pocket 41 now directs the grist laterally towards the innermost pocket 61 of the stationary grinding disc 50. The grist then alternately passes between the pockets of the rotating and stationary discs until finally leaving the grinding zone from pocket 66.

Figure 5A:
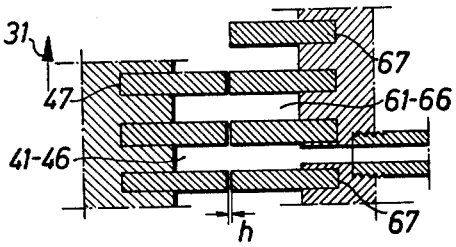
FIGS. 5A–5C show a section along the line V—V in FIG. 3.
Figure 5B:
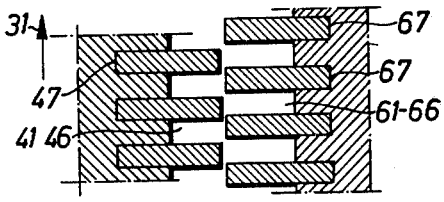

In FIG. 4 is shown how the pockets in both grinding discs are open communication with each other corresponding to the position shown in FIG. 5A. When the rotary grinding disc moves in the direction indicated by the arrow 31, the bars 47 move from the position shown in FIG. 5A, where the pockets are in full open communication with each other. In FIG. 5B this communication is closing and in FIG. 5C the opening is fully closed with the exception of the narrow grinding space set by the hydraulic servomoter controlling the axial position of the rotating shaft. In this manner any specific pocket in the stationary disc is passed by 10800 pockets in the rotating disc every second corresponding to one tenth of a millisecond for each pocket to pocket communication. Despite this short swell time flow of grist from the pockets in the rotating disc to the pockets in the stationary disc is not clogged. This can be observed if the flow of chips fed to the refiner is shut off and the refiner disc is brought to a stand still. When the refiner is opened for inspection the pockets of the rotating disc are found completely empty. When the propelling action of the grist coming from the rotating disc has ceased pulp will remain in the stationary pockets.

The grist coming from the pocket 41 moves with very high velocity, around 82 m per second, and has thus acquired a considerable quantity of kinetic energy of motion. When the grist is projected into the stationary pocket, it exerts a considerable mechanical pressure on the grist already collected therein compressing it to a density of about 0.79 g per $cm^3$. The internal friction created when the edge of the next oncoming bar cuts into the body of grist produces the required refining effect. This action can be modified by the setting of the distance between the grinding discs. E.g. when pulp for newspint is produced a distance between 0.1 and 0.2 mm may be used. When tissue paper is produced a distance of 0.3 to 0.5 mm may be used. Pulp for egg containers may be produced with a setting of up to 0.7 mm.

When the grist from the rotating pocket 41 is pressed against the mass of grist collected in the stationary pocket 61 as shown by the arrow A in FIG. 4, a wedge shaped portion of this mass will "tilt" into the pocket 42. This will then be "shaved off" by a bar 67 and subsequently accelerated by the centrifugal force and finally deflected into the pocket 62.

Each time the grist is arrested the kinetic energy of rotation is transformed into heat, raising the temperature of the grist. As the temperature of the grist affects the quality of the pulp, it is of certain importance to counteract these fluctuations. As the whole process of refining is carried out at a temperature very close to the boiling point of water, whether this is done under atmospheric conditions or under steam pressure in a pressurized refiner, this heat will also cause evaporation to such an extent that the moisture content of the grist may be reduced. As the intensity of the shearing forces developed in the friction surfaces within the body of grist is highly dependent upon the amount of moisture present, the water evaporated must therefore be compensated for. This is done by injecting an appropriate amount of water, e.g. through the conduit 55.

The grist diverted from the pocket 41 has a velocity of about 80 m/sec giving it a centrifugal acceleration of 1330 g and is pressed against the grist in the pocket 61, where it comes to an instant stop. The stationary pocket 61 is filled with compressed grist with the fibers oriented perpendicularly to the bars. The kinetic energy of the grist is converted into heat, which evaporates moisture. This transfer is repeated each time the pockets in the two grinding discs open into each other. When the bars 47 shear through the compacted grist, frictional surfaces are developed between which the fibers are separated from each other and fibrillated. The power from the driving motor is thus transferred to the grist by means of the bars 47 to kinetic energy of rotation by centrifugal acceleration of the grist on the order of 1000 g to 1500 g. By directing the flow of grist, it is possible to develop the internal frictional forces necessary effect the fiber separating and obtain the desired fibrillation.

It has been mentioned that each time a communication takes place between the pockets 41 and 61 of the rotating and the stationary pockets as shown in FIG. 5A, a new quantity of grist is transferred to the pocket 61. It has also been mentioned that the grist compacted in the stationary pockets, thanks to its geometrical form of a circle segment, will pivot in the pocket around its geometrical center point 49 of the sector as indicated by the line 69 in FIG. 4. This means that the flow of grist through the refiner is maintained as long as new material is supplied through the gate 40 to the pocket 41. This in turn implies that when grist is continuously supplied to and compacted in the entrance part of the stationary pocket 61, a corresponding quantity of grist is pressed out and sliced off from the exit part of the pocket 61 into the pocket 42 of the refining member 30 of the rotating disc. During the passage to this pocket, new friction surfaces will be developed within the grist as the rapidly moving bar 47 cuts through the compacted body of fibrous grist which is prevented from being passed into pocket 42 by the bar 67. In this manner the grist will alternately move between the moving and the stationary pockets until it finally leaves the stationary member 50 through one of its exits 66 at the periphery of the grinding disc.

Depending upon the adjustment of the distance between the grinding discs and also upon the relative quantity of grist carried in the stationary pockets, a portion of the grist may pass directly radially from the pocket 41 passing through surfaces of friction developed by an edge designated by the numeral 51 in FIG. 4.

Figure 5C:
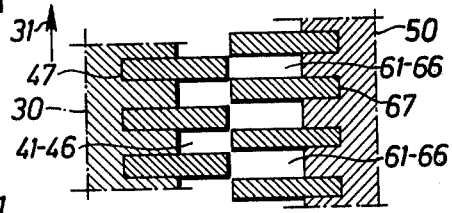

In FIGS. 5A to 5C it is shown that when the bars 47 pass by the bars 67 the passage between the pockets of the rotating and moving members of the refiner is alternately opened and closed. In a 50" refiner, which herein has been used as an example, this is repeated for each bar with a frequency of nearly 10,000 times per second. The bodies of grist emerging from the stationary pockets have then been acted upon by forces varying between a magnitude of a few kg per $cm^2$ to zero which accomplishes the transfer of the grist through the pockets. This vibratory effect also assists in compacting the grist so as to make possible the development of frictional forces of high intensity as the grist passes from a stationary pocket to a rotating pocket.

The distance between the opposing narrow edges of the bars of the rotating and stationary refiner members in FIG. 5A numbered 47 and 67 respectively corresponds to the "refiner disc distance" an important operating factor of the refiner, depending upon operating conditions, type of raw material and type of fibrous pulp desired. In some cases when a very finely refined pulp is desired the distance may even be reduced to 0.05 mm but in such a case the capacity of the refiner is reduced. Pulp of a CSF freeness of down to 2 millimeters may then be produced.

The grinding disc distance will in most cases be a multiple of the diameter of a fiber of most vegetable raw materials which e.g. for the tracheids of spruce generally is around 0.02 and 0.03 mm. A direct cutting of the fibers between the surfaces of the leading edges of the bars of the refiner therefore is not possible. The grist is refined by the interaction between the edge of the bar and the body of compacted grist. The mechanical effect on the fiber is therefore dependent upon the state of the frictional forces developed within the grist. This is of course in turn dependent upon the mechanical stability of the refiner which should be rigid enough to prevent direct metallic contact between any surfaces of the grinding discs.

To accomplish a separation of the fibers from each other and for a further segregation of e.g. the anatomical parts of a coniferous tracheid and to accomplish the desired refining effect on the pulp, the grist has to be compressed to such a degree that within the grist regions of stresses of sufficient magnitude are developed.

The pre-requisite for such conditions is accomplished especially within such regions of compressive stresses which are developed at passages between the rotating pockets 41–46. Depending upon the diameter of the refining discs the moving grist may be compressed by a centrifugal force of around 500 g and even up to 1500 g when it comes to a sudden stop in one of the stationary pockets 61–66.

The fields of frictional forces developed at the crossings from the stationary grinding disc 50 to the rotating disc 30 have on the other hand another character, more like a "slap on the ear". When the grist is accelerated by the bar 47 into the pocket 42 the action is different. The strains there are more like the action of a blunt knife cutting through a piece of cheese. In the compressed grist forced from the stationary grinding disc the rotating bars will thus also create surfaces of friction. Then in the rotating pocket 42 the grist sliced off and fluffed by the bars 47 is accelerated to a considerable velocity and the grist is diverted from the rim 49 in the pocket 42. From there it is transferred to the stationary pocket 62 and there again arrested to zero angular velocity with a loss of kinetic energy and a repeated raise in temperature.

The lignocellulose substance is hydrophilic and, when moist, thermoplastic. When its temperature is raised to the boiling point of water (100° C.), it starts to soften and when the temperature reaches 140°–150° C. for different ligno-cellulose materials the strength of the bond between the fibers is very weak.

The refining process according to the invention is preferably carried out in closed refiners generally called "pressurized refiners" in which the refining process can be carried out under steam pressure. The desired temperature can then be maintained during the refining process. The energy required to raise the temperature to the desired level is obtained from the heat liberated in the refining process. The quantity (amount) of mechanical energy used for the refining process, generally around 800 kWh up to 2000 kWh per ton of pulp produced, will liberate more heat than is required to keep the grist at the appropriate temperature e.g. 130° C. The heat will then evaporate a portion of the moisture contained in the grist. Thus if the mechanical work needed to carry out the refining process according to the invention corresponds to 800 kWh per ton of dry wood substance the heat used will correspond to 688,000 kcal per ton of dry substance. If the process is carried out at 120° C. (and at a corresponding steam pressure) to take advantage of the thermoplastic softening of the wood at that temperature 1309 kg water per ton of wood processed will evaporate.

Assuming that in the example quoted the wood chips fed to the refiner had a moisture ratio of 2:1 the moisture ratio would be reduced to 0.7:1 by evaporation. If a moisture ratio of the grist of 2:1 during the process is necessary for obtaining acceptable refining result a corresponding amount of water should be added to the grist in the zone of refining. Conduits for such addition are shown at the numeral 55, in FIGS. 1 to 5. In the process according to the invention the amount of water added may be automatically controlled.

The water added will be rapidly distributed on the surfaces of the fibers of the grist and will therefore influence the state of friction between the fibers and thereby the process of refining. When the moisture ratio of the grist rises the thickness of the liquid film will increase. Too thick a film will act as a lubricant and will lessen the efficiency of the refining process. When the moisture ratio decreases to 1:1 or less there is considerable risk of formation of microscopic nodules or bundles of fibers that are difficult to untangle by post refining. An increased amount of water will also increase the energy consumed to accelerate the grist in the pockets of the rotating grinding disc.

When examining microphotographs of a cross-section of spruce wood fibers (tracheids) magnified 50 times it is easy to recognize the cross-sections of the individual fibers and how their size varies within the year rings. A statistical study shows that tracheids generally have a cross-sectional area of $0.03 \times 0.03$ mm corresponding to about 100,000 fibers per $cm^2$. The fiber length is about 2.5 mm giving a number of about 400,000 tracheids per $cm^3$. The dry weight of spruce wood is about 0.42 g per $cm^3$ which indicates that one g ($=2.4$ $cm^3$) of spruce wood contains about 1,000,000 fibers and that the combined surface of separated whole fibers is about 3 $m^2$ per g of wood. Refined grist, depending upon its CSF-value, may have a 10-fold combined surface. The liquid film distributed on the particles is calculated to be a film of a thickness of less than one thousandth of one millimeter. However, the large surface involved in refined pulp and the thin water film in addition to the hydrophilic properties of the wood substance a limited excess of water can be permitted without seriously diminishing the desired frictional forces within the grist.

A refiner equipped with grinding discs according to the invention creates a greater number of efficient frictional surfaces within the grist than has been possible with any previously known type of refiner. It is also possible in a refiner applying to the invention to use bars more resistant to abrasion than earlier. This is possible also because of the novel manner in which the bars have been embedded in the body of the disc.

The surfaces of friction which are developed within the grist can also be adjusted in relation to the distance between the surfaces of the rotating bars and the stationary bars. Efficient refining action can therefore be accomplished when a greater distance or clearance is used than has been possible with earlier known designs. This means less abrasions of the opposing surfaces of the bars. Such increased distance also counteracts excessive shortening of fibers through cutting.

The bars used in the refiner discs according to this invention will gradually be subjected to wear on the opposing surfaces, which may result in dullness of the leading edge. Worn bars can easily be replaced with new bars.

With an axially adjustable ring 56 outside the periphery of the stationary grinding disc 50 it is possible to regulate the area of exit from the outermost located stationary pockets 66 to retard, if desired, the rate of flow of grist between the grinding discs 30 and 50, by means of adjusting the nut 57.

The bars 47 and 67 can be made from hard abrasive materials like carborundum, silicone carbide or other ceramic materials. The circular rings 30 and 50 can be made from softer material more easily machined and can therefore be made in full circular ring construction, depending upon type of refiner. The bars are held in machined radial slots preferably by high strength synthetic organic glues according to known methods. The bars can also be cast into such components. Thanks to the curved contours of the grooves 41–46 and 61–66, the bars are held with great stability.

The components of the secondary grinding zone of the grinding elements shown in FIG. 1, numerals 20 and 24, may also as an alternative be designed similar to the elements 30 and 50 in the same FIG. 1. The working surfaces of the grinding discs should after assembly be finished to the highest possible accuracy for best performance when the refiner is in operation.

The first pocket 41 of the grinding disc 30 has an innermost radius of 528 mm. When grist with a moisture ratio of 3:1 is accelerated to a velocity of 83 m per second the required kinetic power input will be 14.5 kWh per ton of pulp calculated as oven dry. When the grist enters the pocket 61 of the stationary grinding disc 50 it is retarded to zero velocity but when leaving this pocket it is again accelerated in pocket 42. The grist passing through the refiner is thus accelerated and stopped successively six times, one time for each row of pockets. This would correspond to a power consumption of about 95 kWh per ton of pulp produced. As described above when the grist in a compacted form emerges from the stationary pockets surfaces of friction are generated by the edges of the bars. The intensity of this friction can be modified by setting the grinding disc distance as indicated above. The power used for the refining process may thus be varied from a few hundred up to 1000 kWh per ton of ordinary types of pulp. When pulp of special low freeness values is required up to 2000 kWh per ton of pulp may be used. With increased grinding disc distance a short cut may be created allowing a portion of the grist to pass over the rims 51 directly from a pocket to the next radial pocket. A considerable loss in refining intensity will occur but the power consumption per ton will decrease.

Figure 6:
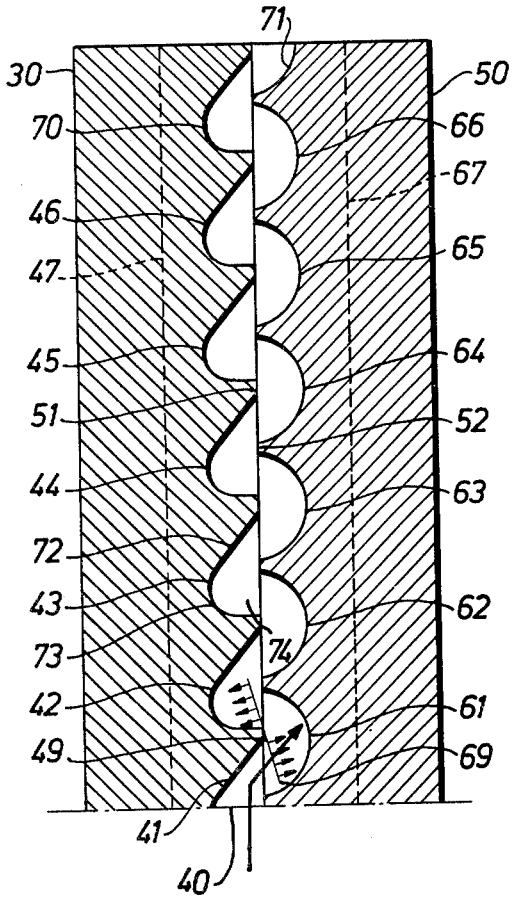
FIG. 6 shows a vertical section through a refiner disc according to a modified embodiment of the invention.

In the embodiment disclosed in FIG. 6 the pockets 61–66 and 71 of the stationary grinding means 50 in an axial section have the shape of a circle, just as in the preceding embodiment, the radius of said segment corresponding to the full depth of the pocket or being somewhat larger. Also the individual pockets of the grinding means 30 are curved in an axial section through the grinding means. In contrast to the embodiment of FIG. 4, the individual pockets 42–46 and 70, have a gradually sloping wall section 72 at the radially outer face thereof, said section being plane or approximately plane and at the bottom of the pocket tangentially changing to a wall section 74 extending perpendicularly or approximately perpendicularly to the grinding surface formed by the edges of bars 47 and rims 51. The arc-like section 73 may have a radius of curvature approximately corresponding to the full depth of the pocket. In this manner the rotating pockets will form an outline having a relatively long and flat deflection surface for the grist. At the radially inner side of the grinding means 30 said grist is fed through a port 48 and at a high speed is hurled into the innermost stationary pocket 61, as disclosed by arrow A, where the grist will be instantaneously stopped and fills up the pocket as a compact plug or body. The latter slides along the surface 68 is then brought to the innermost rotating pocket 42, the plug then passing between the bars 46 and 67, respectively, shearing or friction surfaces then being shaped in which the separate fibres or fibrilles of the grist are separated from each other. Due to the circle segment of the pockets, the plug of the grist collected therein will be rotated about a centre 49, as indicated by line 69, by the subsequent grist hurled through said port 41. Said plug will then get into contact with the rotating bars 47 which disintegrate the grist while peeling the same. In the rotating pocket said grist is now instantaneously accelerated to the high speed of the grinding means, the grist then being compacted and due to the sloping, elongated plane 72 and a favourable distribution of the components of force in the radial and axial direction also being passed into the next pocket 62, where, once more, a plug in the shape of a segment of a circle is generated. The cycle is repeated at the alternate passages outwards of the grist between the stationary and rotating pockets and the obtained final product is fed out through the last stationary groove 71.

What I claim is:

1. In a grinding apparatus for producing grist from ligno-cellulose material in which the material is ground in a straight grinding space (h) defined between a rotating disc (12) and a stationary disc (16) arranged within a housing (10), each of the discs comprising a plurality of substantially parallel radial bars (47, 67) and interconnecting transverse ribs (51, 52) defining a plurality of radially disposed pockets having a curved profile in cross section, the pockets in one of the discs being offset radially relatively to the pockets in the other disc to form a sinuous uninterrupted passage for the grist as it is propelled radially outwards in the grinding space by centrifugal force; the improvement in which the pockets in the respective discs are profiled so that the grist is deflected by a passing rotating pocket into a corresponding offset stationary pocket and retained therein while being compressed by successive charges of grist to a degree sufficient to develop frictional stress forces within the retained grist to promote disintegration thereof and to cause the thus compacted grist to pivot about the profiled surface of the pocket until aligned with a rotating pocket wherein it is fluffed and accelerated into a successive stationary pocket upon being sheared off by the following bar, the grinding space being defined between the free edges of the radial bars (47, 67) which extend outwardly the full depth of the pockets to the grinding space and the transverse ribs (51, 52), which radial bars and transverse ribs are located in two mutually spaced planes.

2. Apparatus according to claim 1, in which the bars (47, 67) are composed of material substantially harder than the disc material.

3. Apparatus according to claim 1, in which the bars (47, 67) in one of the discs have such a width relative to the pockets in the other disc that the radially offset pockets are momentarily closed off from one another during the relative rotational movement between the discs.

4. Apparatus according to claim 1, in which the pockets of the stationary disc have the profile of a circular segment and the rotating pockets comprise a gradually sloping wall section at the radially outer face thereof, said section being substantially plane and merging tangentially with the curvature at the bottom of the pocket.

* * * * *